US009146503B2

(12) United States Patent
Shindo

(10) Patent No.: US 9,146,503 B2
(45) Date of Patent: Sep. 29, 2015

(54) DEVELOPER ACCOMMODATING UNIT, PROCESS CARTRIDGE AND ELECTROPHOTOGRAPHIC IMAGE FORMING APPARATUS

(71) Applicant: CANON KABUSHIKI KAISHA, Tokyo (JP)

(72) Inventor: Go Shindo, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 14 days.

(21) Appl. No.: 13/897,768

(22) Filed: May 20, 2013

(65) Prior Publication Data

US 2013/0308972 A1 Nov. 21, 2013

(30) Foreign Application Priority Data

May 21, 2012 (JP) ..... 2012-115868

(51) Int. Cl.
*G03G 15/08* (2006.01)
*G03G 21/16* (2006.01)

(52) U.S. Cl.
CPC ..... *G03G 15/0898* (2013.01); *G03G 15/0841* (2013.01); *G03G 15/0874* (2013.01); *G03G 15/0882* (2013.01); *G03G 21/1676* (2013.01); *G03G 2215/0682* (2013.01); *G03G 2215/0687* (2013.01); *G03G 2215/0875* (2013.01)

(58) Field of Classification Search
CPC ..... G03G 15/0841; G03G 15/0874; G03G 2215/0682; G03G 2215/0687; G03G 2215/0875; G03G 15/0898; G03G 15/0882
USPC ..... 399/103, 106, 119, 120, 258
See application file for complete search history.

(56) References Cited

U.S. PATENT DOCUMENTS

| | | | | |
|---|---|---|---|---|
| 5,075,727 | A * | 12/1991 | Nakatomi | 399/103 |
| 5,264,901 | A * | 11/1993 | Rossiter | 399/105 |
| 5,594,535 | A * | 1/1997 | Beaufort et al. | 399/106 |
| 8,385,787 | B2 * | 2/2013 | Yamaguchi et al. | 399/258 |

FOREIGN PATENT DOCUMENTS

| | | |
|---|---|---|
| JP | 63-130978 | 12/1988 |
| JP | 04-166963 | 6/1992 |
| JP | 2002-169366 | 6/2002 |
| JP | 2011-047981 A | 3/2011 |

OTHER PUBLICATIONS

English Translation JP2011047981 Koyama Mar. 10, 2011.*

* cited by examiner

*Primary Examiner* — Ryan Walsh
(74) *Attorney, Agent, or Firm* — Fitzpatrick, Cella, Harper & Scinto

(57) ABSTRACT

A developer accommodating unit includes: a container, provided with an opening for permitting discharge of a developer, for accommodating the developer; a sealing member for sealing the opening by being mounted on the container and for being peeled from the container to expose the opening; and an unsealing member for unsealing the opening by moving the sealing member to peel the sealing member from the container. The sealing member includes a sealing portion defined in an end side thereof to seal the opening, a holding portion defined in another end side thereof to be held by the unsealing member, and a developer passing portion formed between the sealing portion and the holding portion to permit passing of the developer therethrough.

26 Claims, 14 Drawing Sheets

DEVELOPER ACCOMMODATING UNIT, PROCESS CARTRIDGE AND ELECTROPHOTOGRAPHIC IMAGE FORMING APPARATUS

FIELD OF THE INVENTION AND RELATED ART

The present invention relates to a developer accommodating unit for accommodating a developer, and a process cartridge and an electrophotographic image forming apparatus which include the developer accommodating unit.

The electrophotographic image forming apparatus forms an image on a recording material (medium) by using an electrophotographic image forming process and may include, e.g., an electrophotographic copying machine, an electrophotographic printer (such as an LED printer or a laser beam printer), an electrophotographic facsimile machine, an electrophotographic word processor, and the like. Further, the process cartridge refers to a cartridge, prepared by integrally assembling at least a developing means and a developer accommodating unit accommodating a developer, detachably mountable to a main assembly of the electrophotographic image forming apparatus.

In a conventional electrophotographic image forming apparatus using the electrophotographic image forming process, a process cartridge type in which an electrophotographic photosensitive member and process means acting on the photosensitive member are integrally assembled into a cartridge and this cartridge is detachably mountable to a main assembly of the electrophotographic image forming apparatus is employed.

In such a process cartridge, a type in which an opening provided to a developer accommodating frame for accommodating a developer (toner, carrier, etc.) is sealed with a sealing member, and then a welding portion of as a sealing member is peeled off at the time of use to unseal the opening, thus enabling feeding (supply) of the developer has been widely employed. As an invention in which the opening of the developer accommodating frame is opened, those described in Japanese Laid-Open Patent Application (JP-A) Hei 4-166963, JP-A 2002-169366 and JP-A Sho 63-294582 are disclosed.

In JP-A Hei 4-166963, a constitution in which a toner accommodating portion formed with a sheet film is provided inside the developer accommodating frame and when a user pulls a grip, a developer supplying opening of the toner accommodating portion is opened is described. In JP-A 2002-169366, a constitution in which a winding-up shaft of a sealing member is provided outside the developer accommodating frame is provided and when the winding-up shaft is rotated, the developer supplying opening is opened is described. In JP-A Sho 63-294528, a constitution in which the winding-up shaft of the sealing member is provided inside the developer accommodating frame and when the winding-up shaft is rotated, the developer supplying opening is opened is described.

However, in the constitution described in JP-A Hei 4-166963, the user is required to expend effort such that the user pulls the grip, and the sealing member remains in user's hand. Further, in the constitutions described in JP-A 2002-169366 and JP-A Sho 63-249582, the sealing member is peeled off but it is desired that discharging efficiency of the developer is further improved.

SUMMARY OF THE INVENTION

A principal object of the present invention is to provide a developer accommodating unit capable of eliminating efforts of a user to remove a sealing member and capable of improving discharging efficiency of a developer from a flexible container in which the developer is accommodated.

According to an aspect of the present invention, there is provided a developer accommodating unit comprising: a container, provided with an opening for permitting discharge of a developer, for accommodating the developer; a sealing member for sealing the opening by being mounted on the container and for being peeled from the container to expose the opening; and an unsealing member for unsealing the opening by moving the sealing member to peel the sealing member from the container, wherein the sealing member includes a sealing portion defined in an end side thereof to seal the opening, a holding portion defined in another end side thereof to be held by the unsealing member, and a developer passing portion formed between the sealing portion and the holding portion to permit passing of the developer therethrough.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Hereinbelow, embodiments for carrying out the present invention will be exemplarily and specifically described on the basis of Embodiments with reference to the drawings. However, dimensions, materials, shapes, relative arrangements, and the like of constituent elements described in the following embodiments are appropriately changed depending on constitutions or various conditions of devices (apparatuses) to which the present invention is applied, and therefore the scope of the present invention is not limited thereto unless otherwise specified.

Embodiment 1

Figure 1:
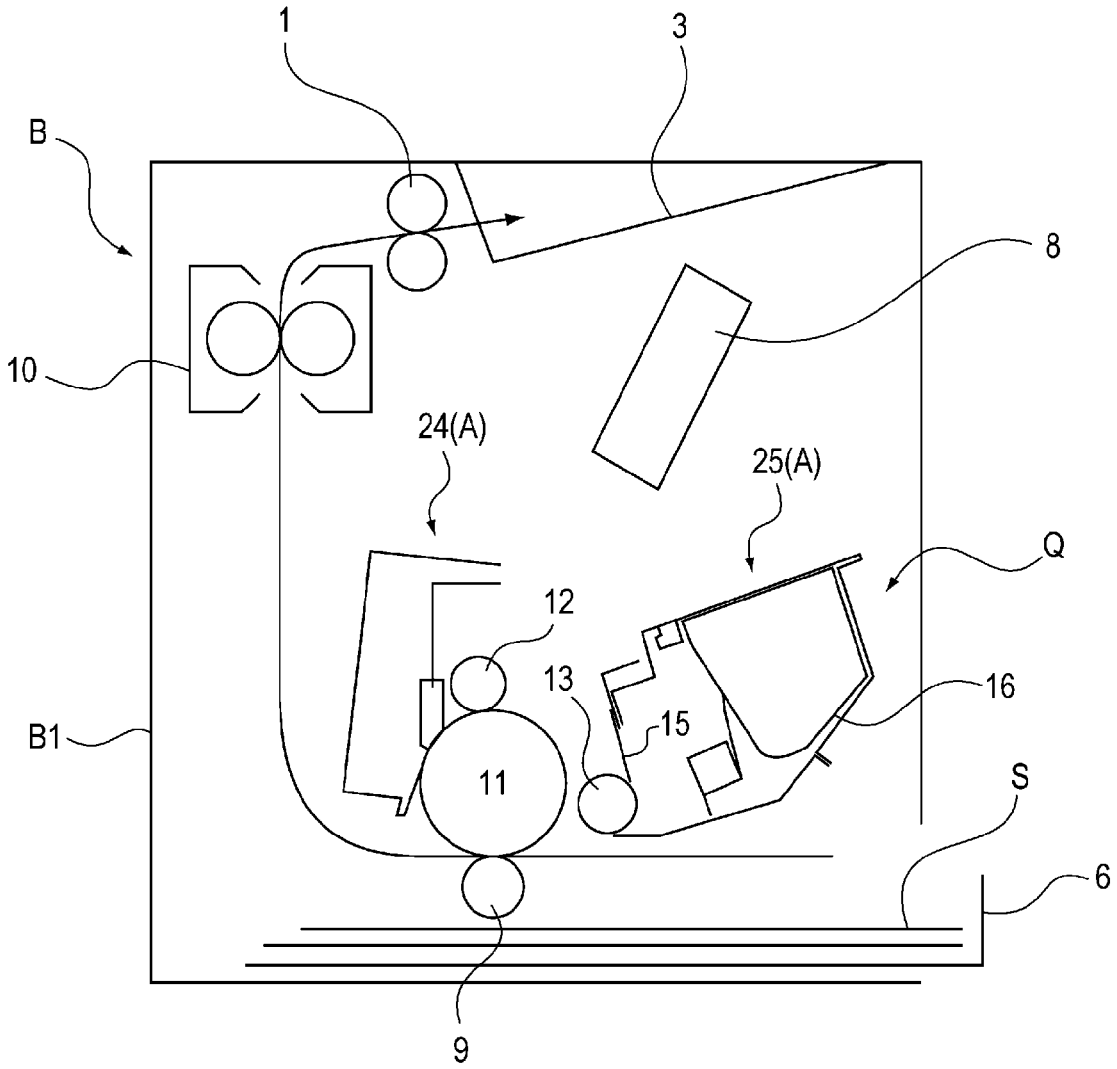
FIG. 1 is a sectional view showing a structure of an image forming apparatus including a developer accommodating unit.

FIG. 1 is a sectional view showing a structure of an image forming apparatus B including a developer accommodating unit 25 (FIG. 2) according to Embodiment 1 of the present invention. The image forming apparatus B is an image forming apparatus using an electrophotographic image forming process. As shown in FIG. 1, the image forming apparatus B includes an image forming apparatus main assembly B1 in which an image forming portion Q for forming an image is provided. The image forming portion Q includes a photosensitive drum 11 as an image bearing member, a transfer roller 9 as a transfer device, and the like.

Inside the apparatus main assembly B1 of the image forming apparatus B, the image forming portion Q, a cassette 6 and a fixing device 10 are provided. The image forming portion Q includes a cleaner unit 24 including the photosensitive drum 11, a developer accommodating unit 25, an exposure device 8, and the transfer roller 9. Of these members, a cartridge A is constituted principally by the cleaner unit 24 and the developer accommodating unit 25. Further, in a conveying path of a sheet S, members consisting of the cassette 6, the transfer roller 9, the fixing device 10, a discharging roller pair 1 and a discharge portion 3 where the discharged sheet S is to be stacked, are provided in this order.

For image formation, in synchronism with the conveyance of the sheet S from the cassette 6, the exposure device 8 selectively exposes the surface of the photosensitive drum 11 to light, so that an electrostatic latent image is formed on the surface of the photosensitive drum 11. Thereafter, the developer accommodated in a developer bag 16 is carried in a thin layer on the surface of a developing roller 13 by a developing blade 15. Then, a developing bias is applied to the developing roller 13 as a developer carrying member, so that depending on the electrostatic latent image, the developer is supplied from the developing roller 13 to the surface of the photosensitive drum 11.

On the other hand, the sheet S is conveyed from the cassette 6 to a nip between the photosensitive drum 11 and the transfer roller 9. The developer image formed on the surface of the photosensitive drum 11 by changing, exposure and development, is transferred onto the sheet S by the transfer roller 9 supplied with a bias voltage. Then, the sheet S on which the developer image is transferred is conveyed to the fixing device 10 to fix the developer image thereon, and then is discharged onto the discharge portion 3 at an upper surface of the apparatus main assembly B1 by the discharging roller pair 1.

Figure 2:
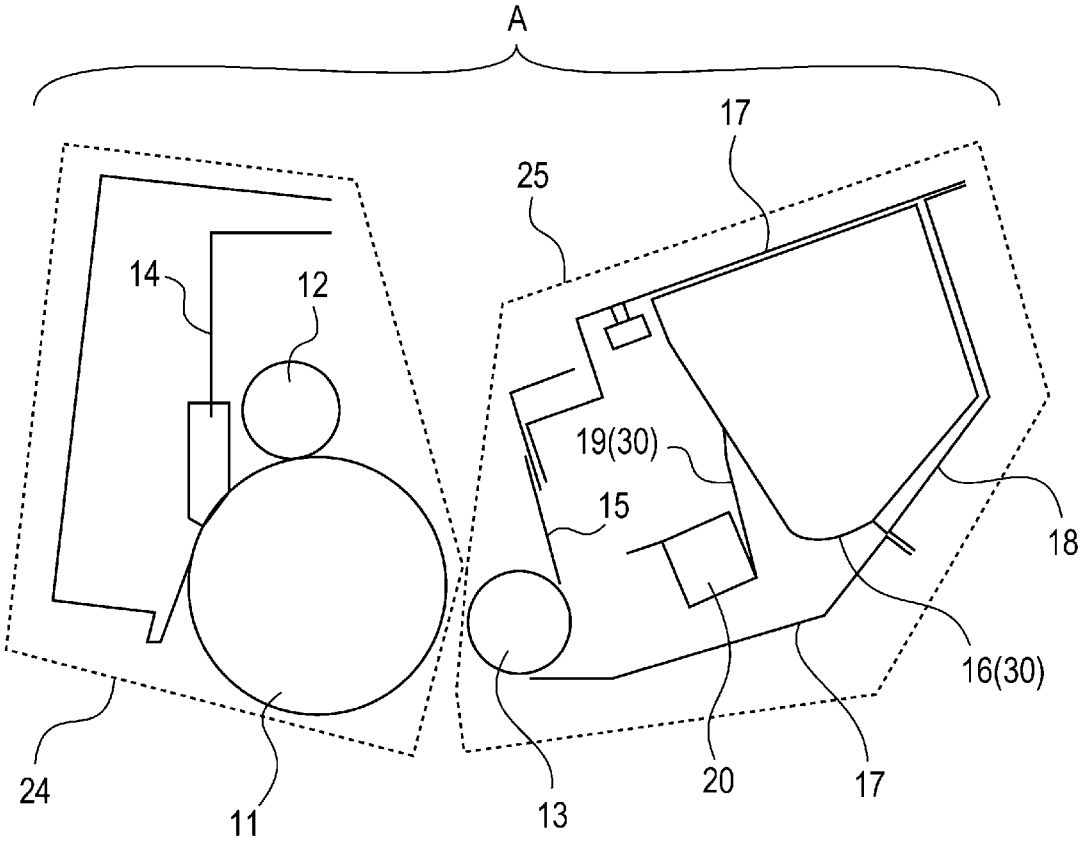
FIG. 2 is a sectional view showing a structure of a cartridge.

FIG. 2 is a sectional view showing a structure of the cartridge A. The cartridge A shown in FIG. 2 includes the image bearing member and process means acting on the image bearing member. Examples of the process means may include, e.g., a charging means for electrically charging the surface of the image bearing member, a developing device for forming an image on the surface of the image bearing member, and a cleaning means for removing a developer (containing a toner, a carrier and the like) remaining on the surface of the image bearing member. The cartridge A will be described specifically below.

The cartridge A as the process cartridge includes the cleaner unit 24 including the photosensitive drum 11 as the image bearing member, a charging roller 12 as the charging means, an elastic cleaning blade 14 as the cleaning means. Further, the cartridge includes the developer accommodating unit 25 including the developing roller 13 and a developing blade 15 which are a developing means, the developer bag 16 accommodating the developer, and a first frame 17 and a second frame 18 which support the developing roller 13 and the developing blade 15. Incidentally, the frame a 17 and 18 accommodate a developer accommodating container 30 and an unsealing member 20 described later.

Further, the cleaner unit 24 and the developer accommodating unit 25 are integrally assembled in the cartridge A and is constituted so as to be detachably mountable to the apparatus main assembly B1 (FIG. 1). In this embodiment, the developer accommodating unit 25 includes the developing roller 13 and the developing blade 15 but may also have a constitution (not shown) in which the developing roller 13 and the developing blade 15 are not included.

Figure 3:
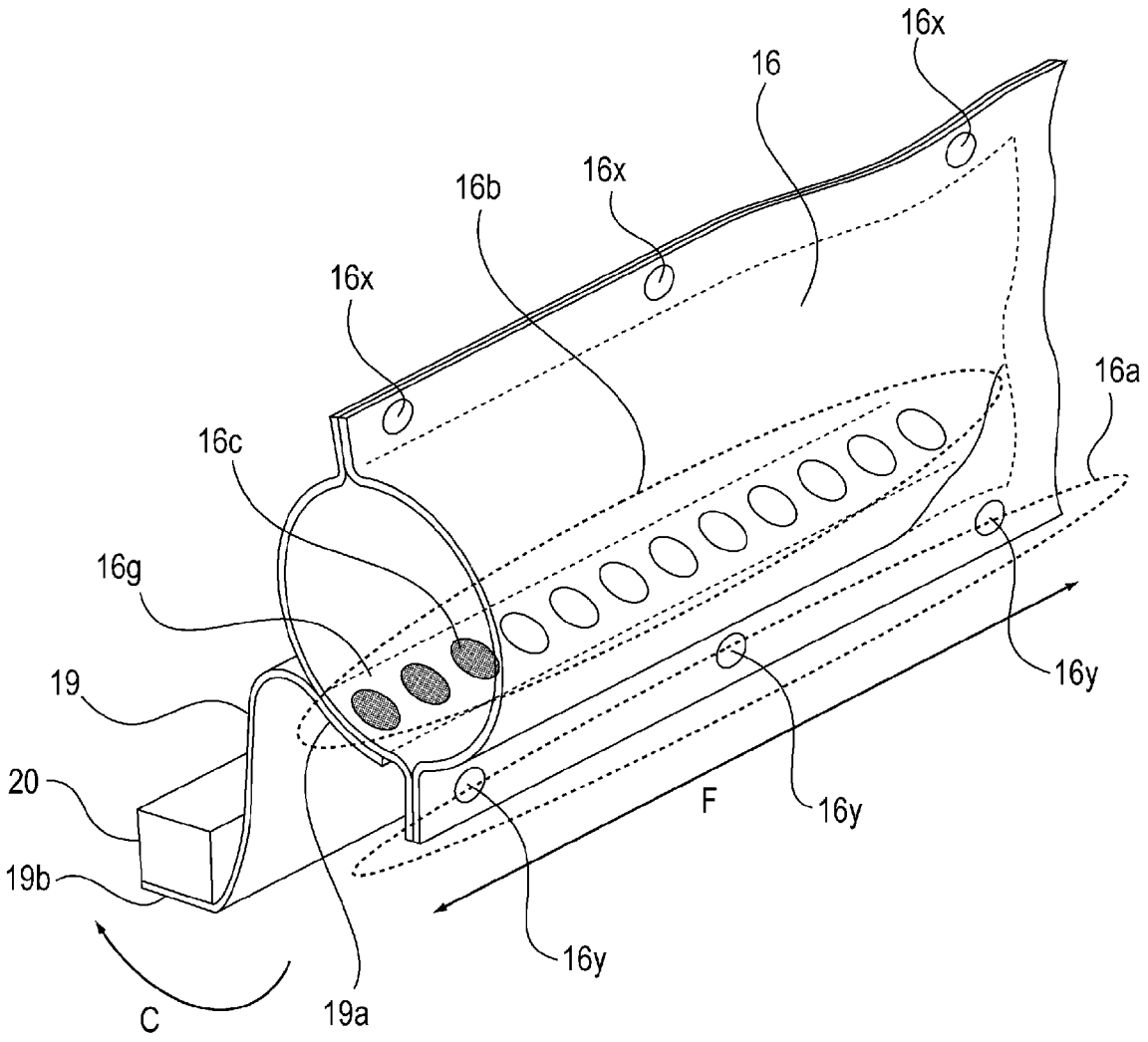
FIG. 3 is a perspective view showing structures of a developer bag, a sealing member and an unsealing member.

FIG. 3 is a perspective view showing structures of the developing bag 16, the sealing member 19 and the unsealing member 20. As shown in FIG. 3, the developer accommodating container 30 includes the developer bag 16 as a flexible container and includes the sealing member 19. The developer bag 16 the developer inside the bag and specifically has the following constitution. The developer bag 16 includes a discharging portion 16*b*. The discharging portion 16*b* includes a plurality of openings 16*c*, for permitting discharge of the developer, arranged in an arrow F direction substantially perpendicular to an arrow C direction in which unsealing advances, and includes a plurality of connecting portions 19*g*. The openings 16*c* open, and the connecting portions 16*g* establishes a relationship with the openings such that the connecting portions 16*g* are interposed between the openings 16*c* to connect the openings 16*c*.

Further, the sealing member 19 is mounted on the developing bag 16 in order to seal the openings 16*c*, and exposes the openings 16*c* when being peeled from the developing bag 16. Specifically, the sealing member 19 is applied onto the discharging portion 16*b* to seal the openings 16*c* so as to prevent the developer inside the developing bag 16 from leaking out of the developer bag 16. The sealing member 19 is formed in a sheet shape.

Further, the unsealing member 20 is mounted on the sealing member 19 at an end portion of the sealing member 19. When the unsealing member 20 is rotated in the arrow C direction, the sealing member 19 is rotated to open the openings 16*c* of the developer bag 16. Thus, the unsealing member 20 unseals the openings 16*c* by operating the sealing member 19 to peel the sealing member 19 from the developing bag 16. As a result, the developer comes out of the developer bag 16.

Figure 4:
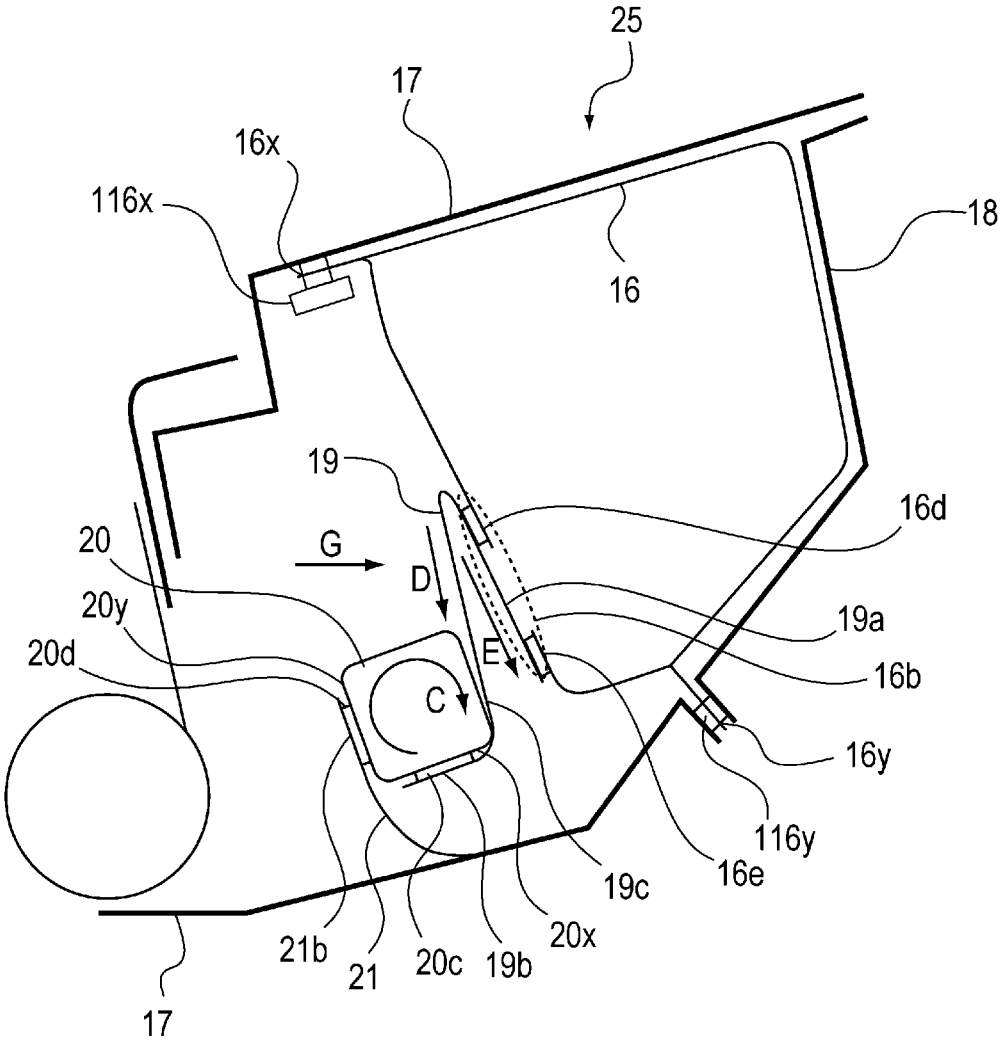
FIGS. 4 and 5 are sectional views each showing a structure of the developer accommodating unit.

FIG. 4 is a sectional view showing a structure of the developer accommodating unit 25. As shown in FIG. 4, the developer accommodating unit 25 includes the developing bag 16, and the sealing member 19 is mounted on the developing bag 16. The sealing member 19 includes a sealing portion 19*a*, a holding portion 19*b* and a connecting portion 19*c*. The sealing portion 19*a* is defined in an end portion side of the sealing member 19 and covers and seals the openings 16*c* (FIG. 3) of the discharging portion 16*b*. The holding portion 19*b* is defined in another end side of the sealing member 19 and is held by the unsealing member 20. The connecting portion 19*c* as a developer passing portion connects the sealing portion 19*a* and the holding portion 19*b* and is formed so that the developer is passable. These portions of the sealing member 19 are arranged from a base end side to a leading end side in the order of the holding portion 19*b*, the connecting portion 19*c* and the sealing portion 19*a*.

Figure 6:
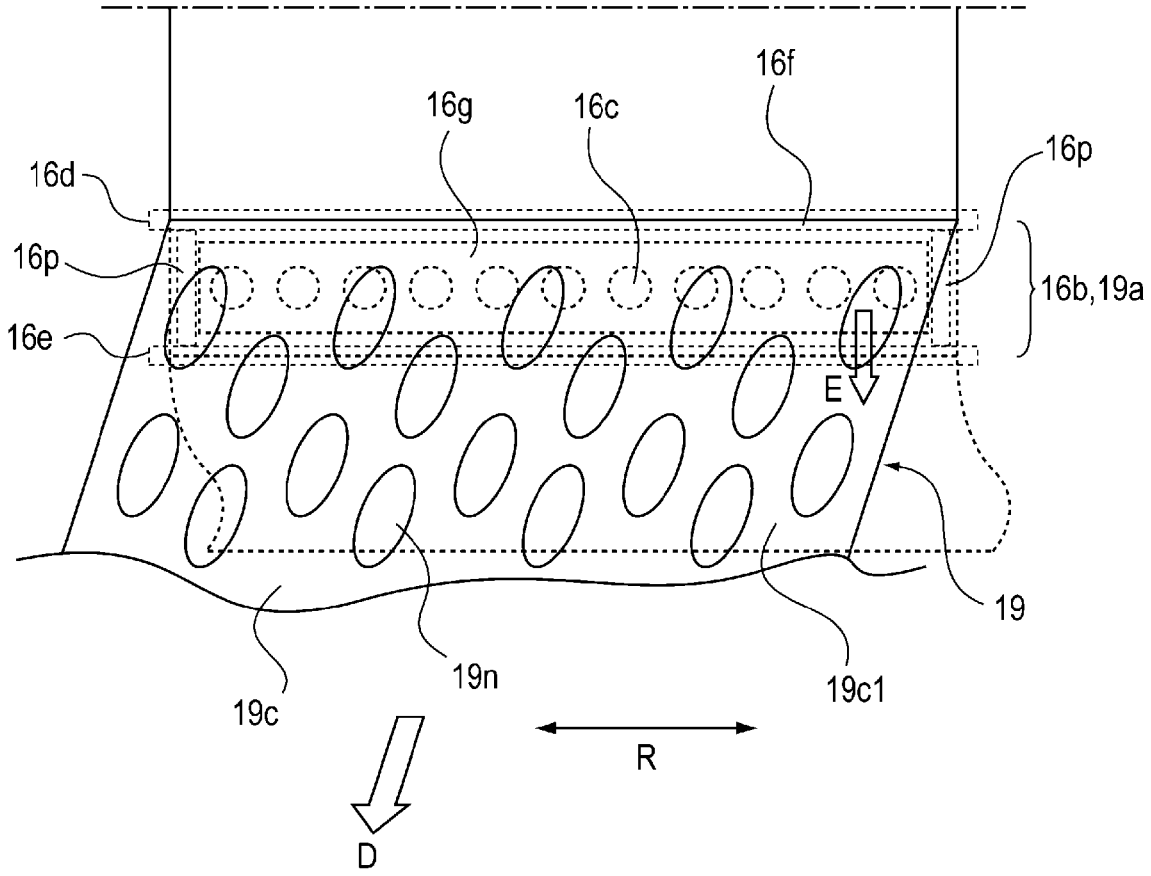
FIG. 6 is an enlarged perspective view showing a structure of the sealing member after being disposed in the developer accommodating unit, and corresponds to a schematic view as seen from an arrow direction indicated in FIG. 4.

The connecting portion 19*c* is provided with a plurality of holes 19*n* (FIG. 6). The sealing member 19 is folded once from the sealing portion 19*a* to the holding portion 19*b*. The sealing portion 19*a* in the leading end side of the sealing member 19 is mounted on the discharging portion 16*b* by a first welding portion 16*e* and a second welding portion 16*d*.

The holding portion 19*b* in the base end side of the sealing member 19 is mounted on the unsealing member 20 by a third welding portion 20*c*.

The unsealing member 20 is rotatably supported about its shaft by the frames 17 and 18. The unsealing member 20 corresponds to a shaft rotatably supported by the first frame 17 and includes a first fixing side 20*x* and a second fixing side 20*y*. Each of the first fixing side 20*x* and the second fixing side 20*y* is constituted by a flat surface substantially parallel to an axis of the unsealing member 20. In the first fixing side 20*x*, the holding portion 19*b* of the sealing member 19 is fixed, and in the second fixing side 20*y*, a holding portion 21*b* of an urging member 21 in a base end side is fixed. The holding portion 21*b* of the urging member 21 is fixed on the second fixing side 20*y* by a fourth welding portion 20*d*, and the urging member 21 urges the developer bag 16 in its leading (free) end side by being rotated. The urging member 21 is disposed inside the frames 17 and 18, and urges the developing bag 16 to deform the developing bag 16.

Next, a fixing state of the inside members of the developer accommodating unit 25 will be described. For fixing, (heat) welding, ultrasonic welding, bonding, pseudo-bonding or the like is employed. The sealing member 19 is fixed on the discharging portion 16*b* at the sealing portion 19*a* in the leading end side in a peelable manner, thus sealing the openings 16*c*. The sealing member 19 is fixed on the unsealing member 20 at the holding portion 19*b* in the base end side.

As the fixing means, in addition to the welding, the ultrasonic welding, the bonding and the pseudo-bonding, it is possible to use clamping by grip-shaped portions, hanging by holes and projections, and the like.

The developing bag 16, the sealing member 19 and the unsealing member 20 are accommodated in the first frame 17 and are also covered with the second frame 18. Then, the first frame 17 and the second frame 18 are bonded by the welding, the bonding or the like, so that the respective members are accommodated inside the developer accommodating unit 25. The developer bag 16 is provided with fixing holes 16*x* and 16*y*.

A fixing portion 116*x* is fixed to the first frame 17 through the fixing holes 16*x*. A fixing portion 116*y* for connecting the first frame 17 and the second frame 18 is fixed to the first frame 17 and the second frame 18 through the holes 16*y*. The fixing portions 116*x* and 116*y* are fixed to at least one of the first and second frames 17 and 18 by using, e.g., a double-side tape, a wedge-shaped member, a hook-shaped member, the welding, the ultrasonic welding or the bonding. Incidentally, the developing bag 16 is provided with the fixing holes 16*x* and 16*y* in a flat side (surface) substantially parallel to the axis of the unsealing member 20.

Next, details and a mutual relationship of the respective members of the developing bag 16 will be described with reference to the drawings 3, 4 and 5. The developing bag 16 includes the discharging portion 16*b* and is clogged by the sealing member 19 as described above. Other sides of the developing bag 16 constitutes a folding-back portion of the bag material or a bag-shaped portion by firmly bonding bag materials to each other by using the welding, the ultrasonic welding, the bonding or the like. In order to realize the unsealing by the above-described constitution, there is a need to always peel the discharging portion 16*b* first, and therefore it is essential that at all of bonding portions of the developing bag 16, strength, i.e., a peeling force of each bonding portion between the sealing member 19 and the developer bag 16 is weakest. This is true for other portions. With respect to a fixing force between the sealing member 19 and the unsealing member 20, a fixing force between the developer bag 16 and the first frame 17 or the second frame 18, or the like force, it is essential that the above-described peeling force is weakest.

On the other hand, the developer accommodating unit 25 functionally accommodates the toner therein, and therefore from the viewpoint of a sealing property, a larger peeling force to the possible extent is advantageous. This is because when the peeling force is large, there is a high possibility that a status in which the openings are unsealed in a state other than an intended state (in which the developer accommodating unit 25 is set in the image forming apparatus B) in the case where an unexpected force (e.g., an impact force during drop) can be avoided. From the above, the peeling force is required to be set at a desired value.

A method of setting the peeling force at the desired value will be described. In this embodiment, in order to set the peeling force at the desired value (a minimum force within a range in which the toner sealing property can be maintained), two methods are principally employed.

In a first method, a laminate material having a special sealant layer which exhibits an easy peeling property (peeling strength of about 3N/15 mm in testing methods for heat sealed flexible packages according to JIS-Z0238) is applied. Further, the first method is a method in which the easy peeling property is exhibited at the peeling portion by using, as the material (member) for the developer bag 16, a sheet material (of, e.g., polyethylene or polypropylene) which is weldable with the special sealant layer and which has flexibility. By changing a combination of formulation of the special sealant layer with the material to be bonded, the peeling force can be reduced.

Figure 5:
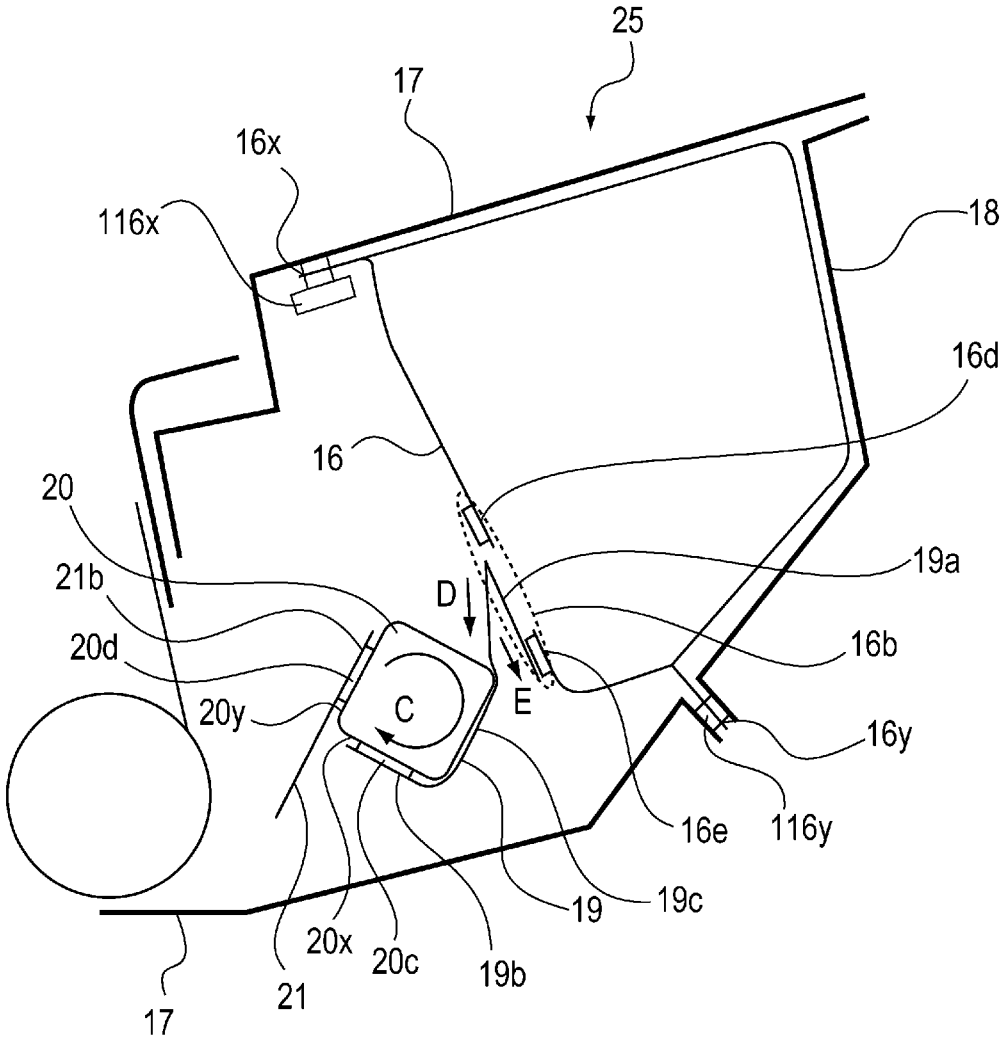

A second method is a method in which as shown in FIGS. 4, 5 and 6, the discharging portion 16*b* of the developer bag 16 is placed in a state in which the sealing member 19 is folded back with respect to an unsealing direction (arrow E direction). For example, in the state of FIG. 4, the unsealing member 20 is rotated in the rotational direction (arrow C direction), so that the sealing member 19 is pulled in a pulling direction (arrow D direction) by the unsealing member 20. As a result, the developer bag 16 and the sealing member 19 establish a positional relationship, as shown in FIG. 4, enabling inclined peeling (peeling at 90 degrees to 180 degrees). It has been conventionally known that the peeling force necessary to separate the both members can be reduced by establishing the inclined peeling positional relationship. Therefore, as described above, the discharging portion 16*b* is placed in the state in which the sealing member 19 is folded back with respect to the unsealing direction (arrow E direction), so that the peeling force can be reduced.

Next, an effect obtained by employing the constitution in this embodiment will be described. As described above, by appropriately shaping the bonding portions between the developer bag 16 and the sealing member 19 and by using the laminate material having the special sealant layer which exhibits the easy peeling property, it is possible to unseal the openings of the developer bag 16 with a small force (the peeling force of about 3N/15 mm at the portion to be unsealed).

FIG. 5 is a sectional view showing a structure of the developer accommodating unit 25. While referring to FIG. 5, structures of the unsealing member 20, the sealing member 19 and the urging member 21 will be specifically described. As shown in FIG. 5, the unsealing member 20 is formed in a substantially rectangular (polygonal) shape in cross section. The urging member 21 has a stirring function for stirring the developer discharged from the developer bag 16 after the discharging portion 16*b* is unsealed (as specifically described later) and has a conveying function for conveying the developer toward the developing roller 13.

FIG. 6 is an enlarged perspective view showing a structure of the sealing member 19 after being disposed in the developer accommodating unit 25, and corresponds to a schematic view as seen from an arrow G direction indicated in FIG. 4. As shown in FIG. 6, the sealing member 19 includes the sealing portion 19*a* for covering the openings 16*c* of the developer bag 16 and a peripheral portion 16*f* of the connecting portion 16*g*. Further, although being not illustrated in FIG. 6, as described above, the sealing member 19 includes the holding portion 19*b* fixed on the unsealing member 20 in the first fixing side 20*x*. Further, as shown in FIG. 6, the sealing member 19 includes the connecting portion 19*c* for connecting the sealing portion 19*a* and the holding portion 19*b*.

The sealing portion 19*a* is welded at the peripheral portion 16*f* of the connecting portion 19*c* connecting the openings 16*c*, thus sealing the openings 16*c*. Specifically, the peripheral portion 16*f* of the openings 16*c* is sealed by the first welding portion 16*d*, the second welding portion 16*e* and a widthwise welding portion 16*p*. The first welding portion 16*d* is welded at the peripheral portion 16*f* in the base end side of the sealing portion 16*a*. The second welding portion 16*e* is welded at the peripheral portion 16*f* in the leading end side of the sealing portion 16*a*. The widthwise welding portion 16*p* is welded at the peripheral portion 16*f* so as to connect the first welding portion 16*d* and the second welding portion 16*e* at each of longitudinal end portions of the openings 16*c*. Incidentally, as shown in FIG. 6, the connecting portion 19*c* includes a continuous member 19*c*1 continuous between the sealing portion 19*a* and the holding portion 19*b* and is provided with a plurality of holes 19, formed on the continuous member 19*a*, for permitting passing of the developer therethrough.

Figure 7:
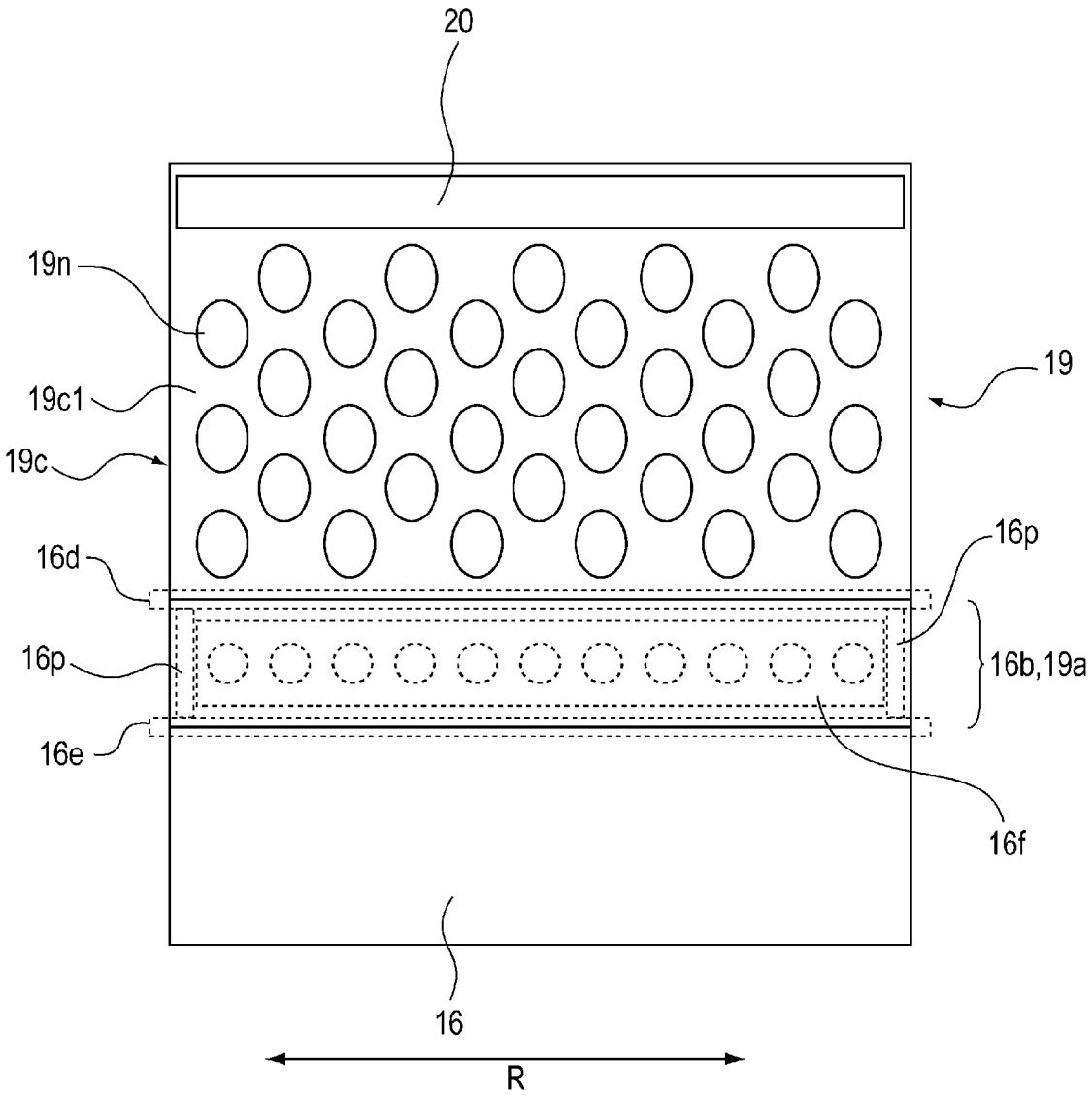
FIG. 7 is an enlarged plan view showing a structure of the sealing member before being disposed in the developer accommodating unit.

FIG. 7 is an enlarged plan view showing a structure of the sealing member 19 before being disposed in the developer accommodating unit 25. As shown in FIG. 7, the connecting portion 19*c* is provided with the plurality of holes 19*n*. The holes 19*n* function as a developer passing portion through which the developer is further passed when the developer is discharged from the openings 16*c* of the discharging portion 16*b*. When the connecting portion 19*c* is provided with the plurality of holes 19*n*, a degree of prevention of discharge of the developer by the connecting portion 19*c* is alleviated (as will be specifically described later). The holes 19*n* may desirably be a circular shape so as not to cause stress concentration since the connecting portion 19*c* is pulled during unsealing or drop. In this embodiment, the holes 19*n* are not illustrated in the figures other than FIGS. 6, 7 and 11.

Figure 8:
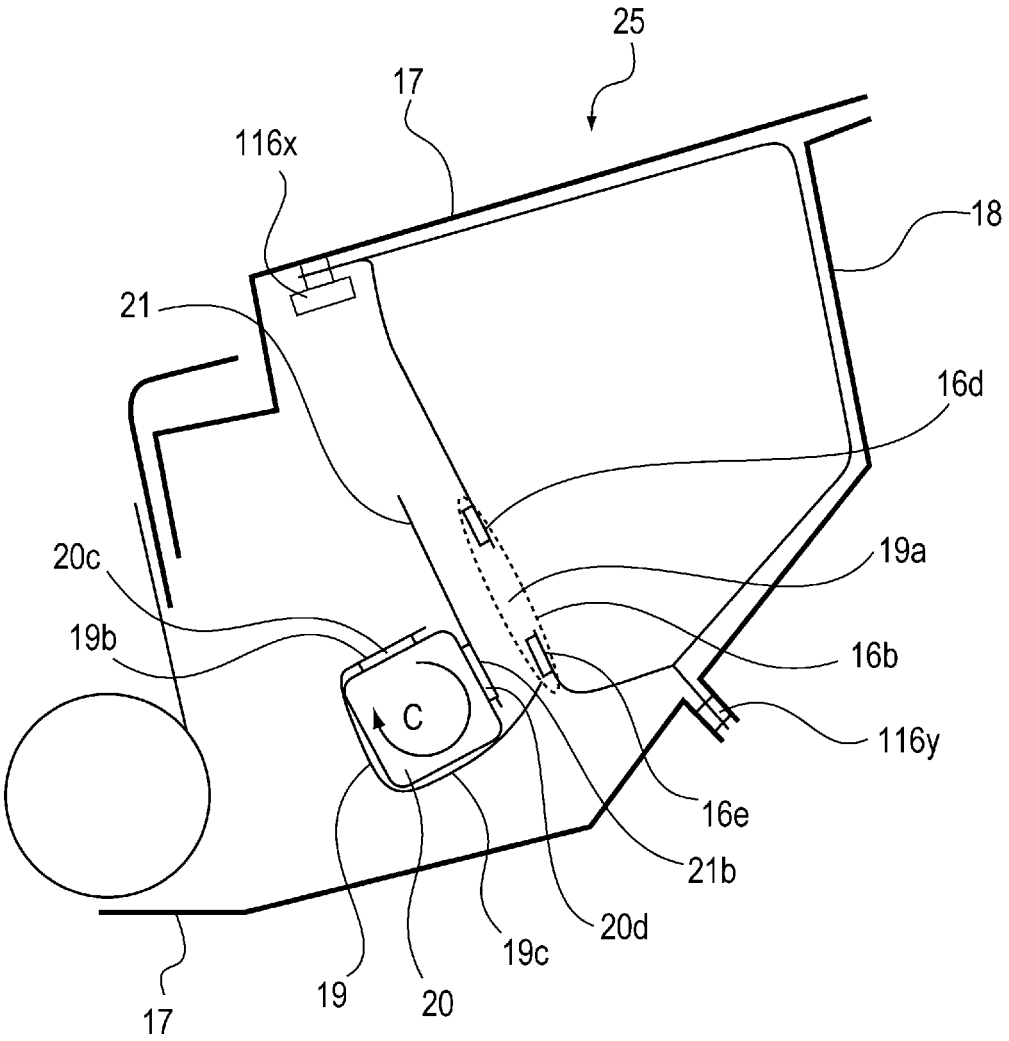
FIGS. 8 to 11 are sectional views each showing a structure of the developer accommodating unit.

FIG. 8 is a sectional view showing a structure of the developer accommodating unit 25. While principally referring to FIG. 8 in combination with FIGS. 4 and 5, an unseal opening of the developer bag 16 will be described.

When the unsealing member 20 is rotated in the arrow C direction, the sealing member 19 is pulled in an arrow D direction (FIG. 4). Then, when the unsealing member 20 is further rotated in the arrow C direction, the sealing member 19 is peeled from the first welding portion 16*d* (FIG. 5). Then, when the unsealing member 20 is further rotated in the arrow C direction, the sealing member 19 is peeled from the second welding portion 16*e*, and as a result, the discharging portion 16*b* is unsealed (FIG. 8).

Figure 9:
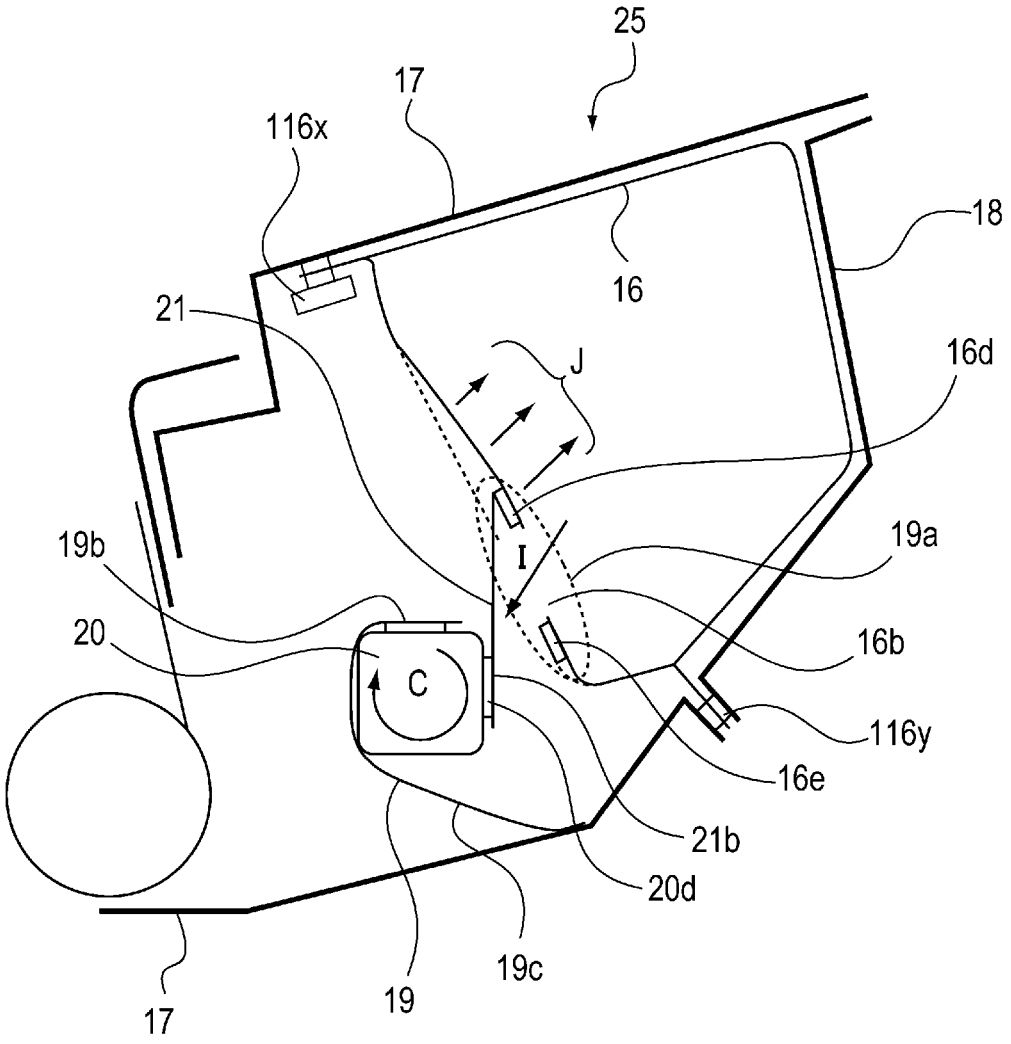

FIG. 9 is a sectional view showing a structure of the developer accommodating unit 25. While referring to FIG. 9, a step of discharging the developer from the developer bag 16 will be described. As shown in FIG. 9, when the unsealing member 20 is rotated further in the arrow C direction after the discharging portion 16*b* is unsealed, the urging member 21 fixed on the unsealing member 20 is rotated. By this opening, the urging member 21 urges the developer bag 16 in an arrow J direction while deforming the developer bag 16. In this way, when the developer bag 16 is urged by the urging member 21, an inside volume of the developer bag 16 is reduced, and thus the inside developer is pushed out, so that the developer is discharged in an arrow I direction from the discharging portion 16*b*.

Figure 10:
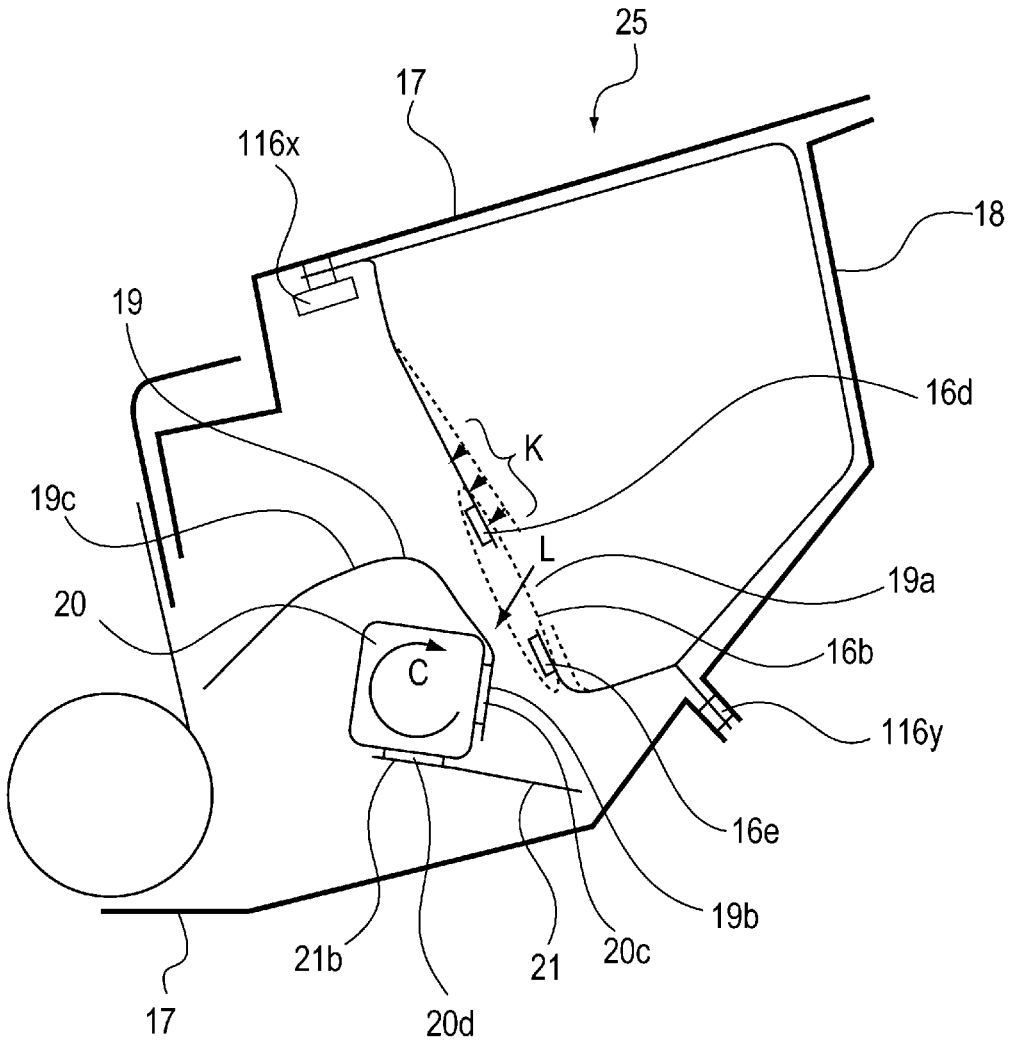

FIG. 10 is a sectional view showing a structure of the developer accommodating unit 25. As shown in FIG. 10, when the unsealing member 20 is rotated further in the arrow C direction, the urging member 21 is separated from the developer bag 16. At this time, the developer bag 16 has elasticity and therefore the developer bag 16 is expanded so as to be restored to a state before being urged by the urging member 21. As described above, also by the rotation of the urging member 21, the urging member 21 urges the developer bag 16 to discharge the developer from the openings 16*c*. When such a cycle is repeated, the developer inside the developer bag 16 is stably discharged (in the arrow L direction). In addition, the discharged developer includes a component to be discharged by its self-weight from the openings 16*c*, a component to be discharged by vibration when the urging member 21 is separated from the developer bag 16, a component to be discharged by flow of the developer inside the developer bag 16 due to deformation of the developer bag 16 (in the arrow L direction), and the like component.

As described above, when the developer is discharged, it is desirable that there is no member in the neighborhood of the openings 16*c*. This is because powder such as the developer has a flowing speed which is slow when it passes through a narrow range and therefore a discharging speed is lowered.

Figure 11:
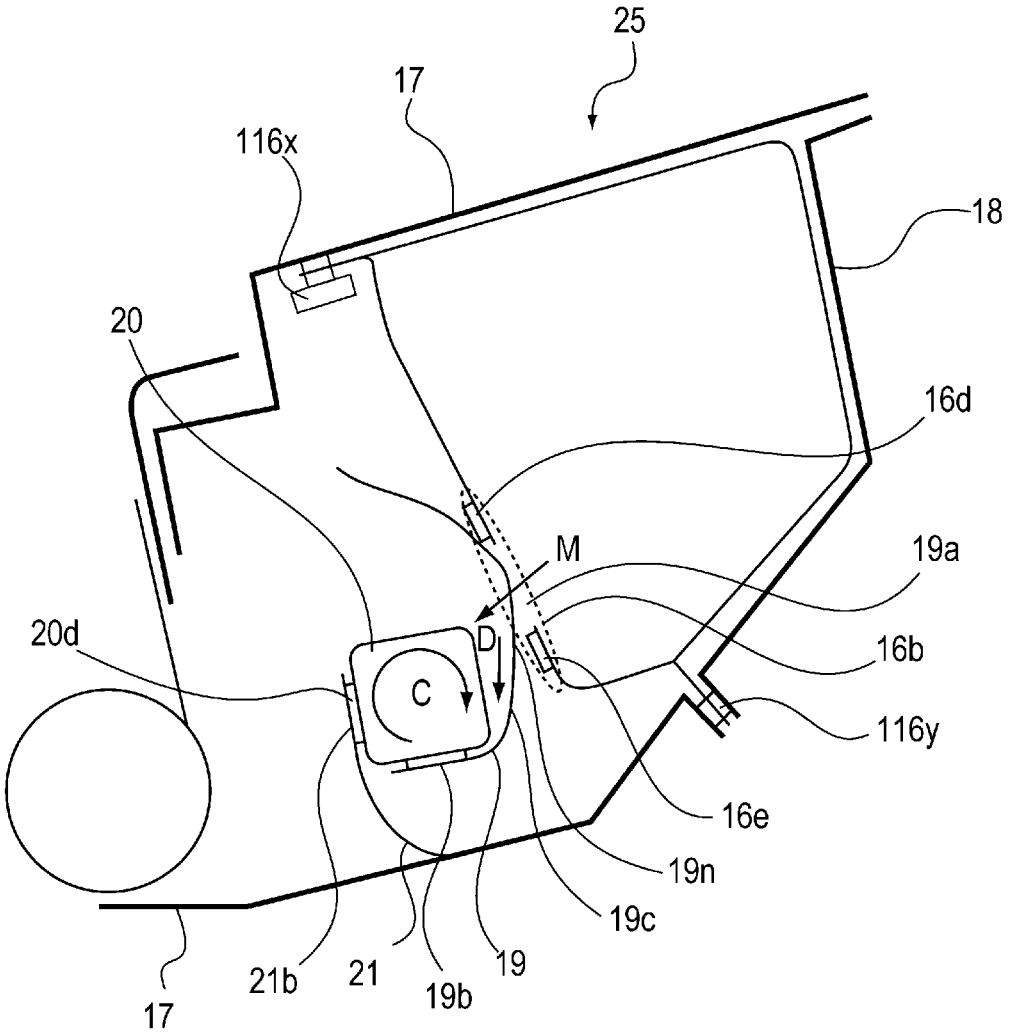

FIG. 11 is a sectional view showing a structure of the developer accommodating unit 25. As shown in FIG. 11, the holes 19*n* provided in the sealing member 19 are set and disposed, when the unsealing member 20 is rotated, so as to pass through positions where they oppose the openings 16*c*. To put it briefly, there are many phases where the sealing member 19 is located in the neighborhood of front portions of the openings 16*c* of the developer bag 16 with rotation of the unsealing member 20. In such a case, when the sealing member 19 is provided with the openings 19*n*, more discharging paths of the developer are ensured, so that the developer is discharged efficiently in an arrow M direction. At this time, it is desirable that the openings 16*c* of the discharging portion 16*b* and the holes 19*n* of the connecting portion 19*c* oppose each other to ensure developer discharging phases with reliability. Further, the sealing member 19 may also function as the urging member 21, and in that case, when the unsealing member 20 is rotated, the developer bag 16 deforms the sealing member 19.

As described above, the unsealing of the discharging portion 16*b* of the developer bag 16 is enabled by only pulling the sealing member 19 in one direction (arrow D direction) by the unsealing member 20, so that the openings 16*c* of the developer bag 16 is stably unsealed with reliability. Further, the cartridge A is pulled in a widthwise direction perpendicular to a longitudinal direction, so that the developer bag 16 can be unsealed, and therefore a peeling distance which is about two times a longitudinal distance of a conventional cartridge can be considerably reduced. The sealing member 19 after being unsealed is fixed on the unsealing member 20, so that it is possible to unseal the developer bag 16 without generating a waste member from the process cartridge.

Further, by the urging member 21 and the holes 19*n*, the discharge of the developer from the inside of the developer bag 16 is quickly made with reliability, thus leading to a reduction in time required from insertion to a printable state of the process cartridge. Further, the developer bag 16 has a bag shape, so that the developer can be treated as a unit, and therefore a developer filling step can be separated from a process cartridge assembling step.

Embodiment 2

Figure 12:
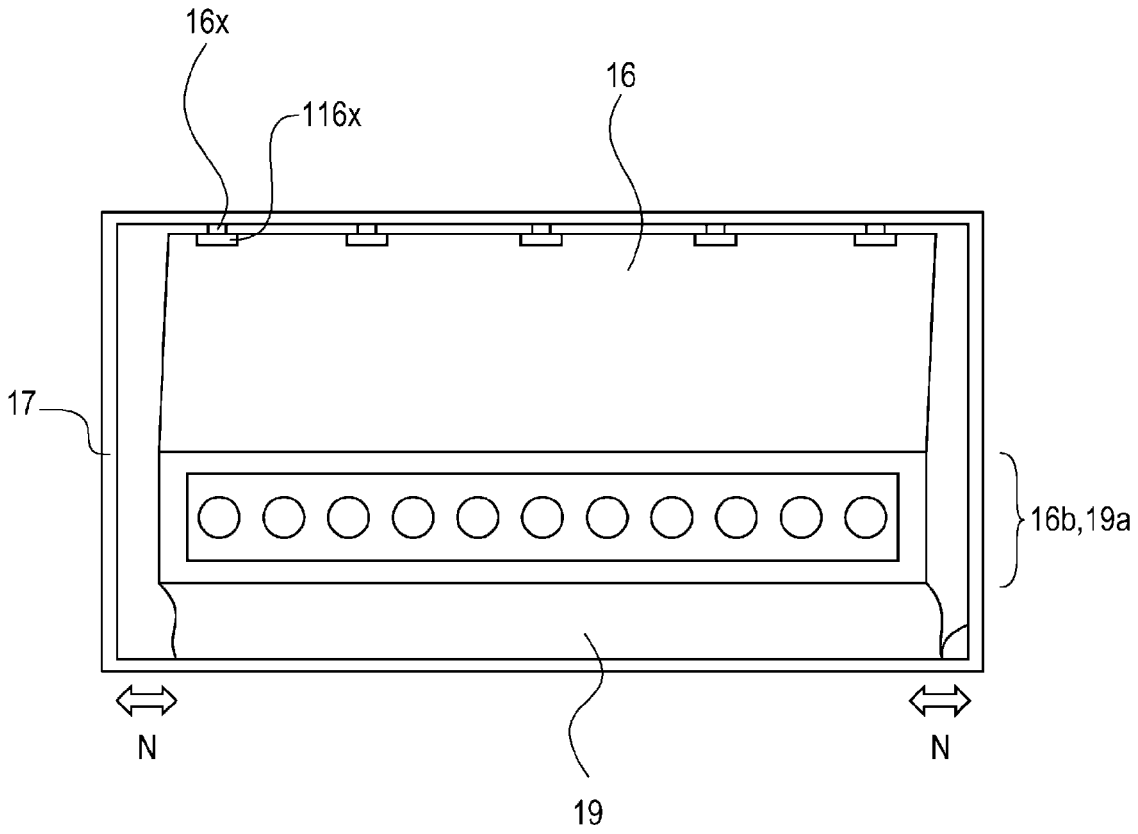
FIG. 12 is an enlarged sectional view showing structures of a sealing member, a developer bag and a first frame before being disposed in a developer accommodating unit according to Embodiment 2.

FIG. 12 is an enlarged sectional view for illustrating a structure of the sealing member 19, the developer bag 16 and the first frame 17 after being disposed in a developer accommodating unit 25 in this embodiment. Constituent elements (members), of the developer accommodating unit 25 in this embodiment, having the same constitutions and effects as those of the developer accommodating unit 25 in Embodiment 1 are represented by the same reference numerals or symbols and will be appropriately omitted from description (similarly applied in Embodiments 3 and 4 appearing hereinafter). Also in this embodiment, the constituent elements can be applied to the developer accommodating unit 25 and the image forming apparatus B similar to those in Embodiment 1, and therefore description of the developer accommodating unit 25 and the image forming apparatus B will be omitted (similarly applied in Embodiments 3 and 4). A characteristic feature in the constitution in this embodiment is as follows.

The developer bag 16 has flexibility and does not have a completely defined shape, so that there is a need to ensure a clearance where the developer bag 16 is assembled with the first frame 17. For that reason, at an end portion of the unsealing member 20 with respect to a rotational axis direction, a space (indicated by an arrow N) where the developer bag 16 is assembled with the first frame 17 is ensured. With respect to the discharge of the developer after the sealing portion 19*a* is peeled, it is desirable that a discharging amount of the developer at the end portion is larger than at a central portion with respect to the rotational axis direction.

Embodiment 3

Figure 13:
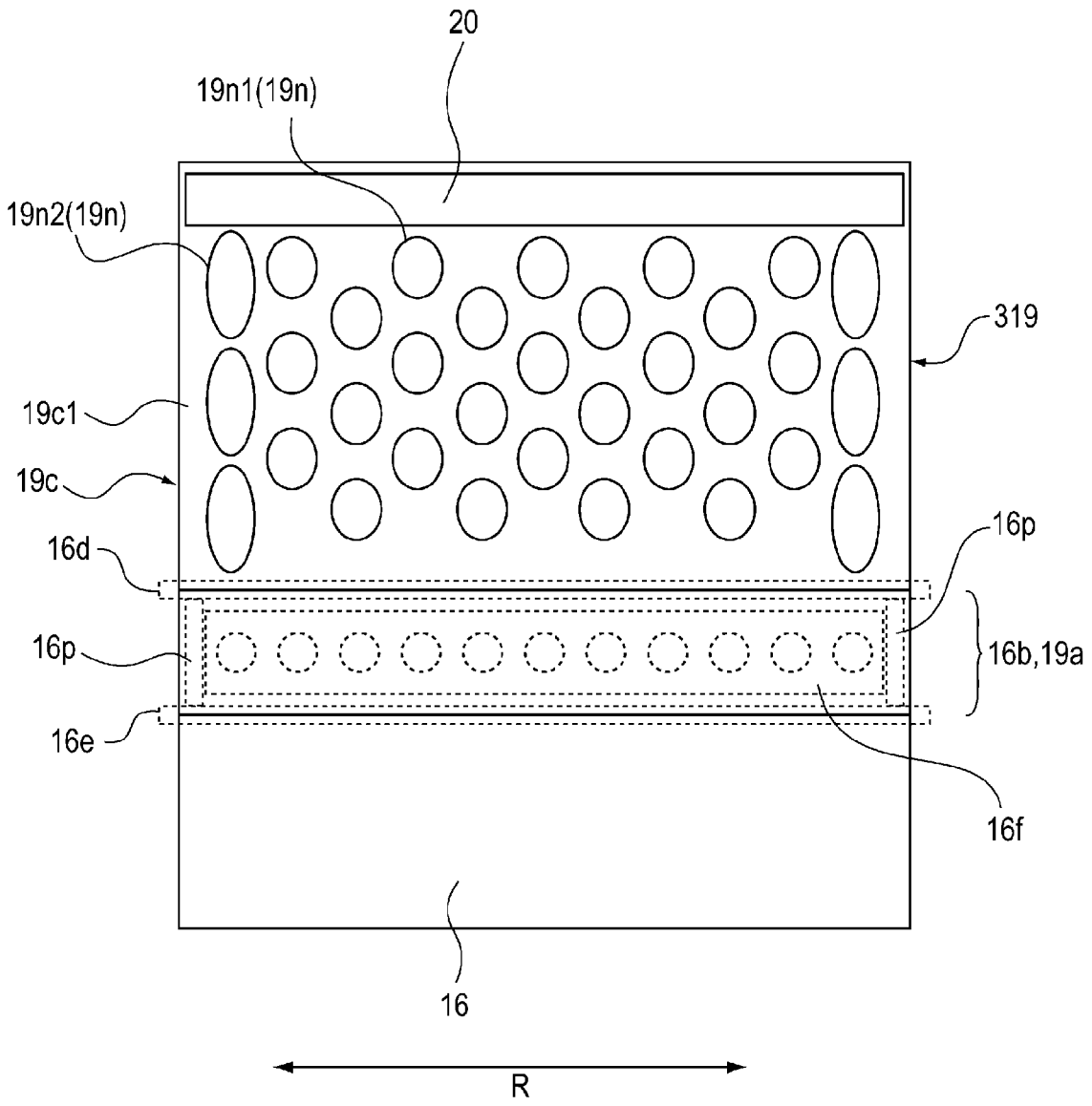
FIG. 13 is an enlarged plan view showing a structure of a sealing member before being disposed in a developer accommodating unit according to Embodiment 3.

FIG. 13 is an enlarged plan view showing a structure of a sealing member 319 before being provided in the developer accommodating unit in this embodiment. FIG. 13 corresponds to a schematic view as seen from the arrow G direction in a state in which the sealing member 319 disposed in the developer accommodating unit is extended. The structure of the sealing member 319 will be specifically described. Constitutions of a welding portion where the sealing member 319 is welded on the developer bag 16 and a fixing portion where the sealing member 319 is fixed on the unsealing member 20 are the same as those in the case of Embodiment 1. The connecting portion 19*c* includes a plurality of holes 19*n*. Of the holes 19*n*, holes 19*n*2 in an end portion side of the continuous member 19*c*1 with respect to an axial direction R of the unsealing member 20 are formed in a larger size than that of holes 19*n*1 in a central portion side of the continuous member 19*c*1 with respect to the axial direction R of the unsealing member 20. For that reason, the holes 19*n* constitute portions through which the developer passes when the developer is discharged from the openings 16*c* of the discharging portion 16*b*, so that a developer discharging amount is larger at the end portion than at the central portion with respect to the rotational axis direction of the unsealing member 20. In this embodiment, a shape of the holes 19*n*2 is an elliptical shape elongated in the rotational direction of the unsealing member 20 but may also be not limited to the elliptical shape.

It would be also considered that all the holes 19*n* are formed in a larger size to the possible extent, but a range in which the size can be increased is limited by a balance with the strength (stiffness). The size of each of the openings 19*n* at the central portion and end portions of the unsealing member 20 with respect to the rotational axis direction may only be required to be determined within the range.

By the constitution described above, in addition to the effect in Embodiment 1, an insufficient feeding force to the end portions can be compensated by ensuring the assembling space, so that also the developer discharge is quickly performed with reliability. Accordingly, the time required from the insertion to the printable state of the process cartridge can be reduced.

Embodiment 4

Figure 14:
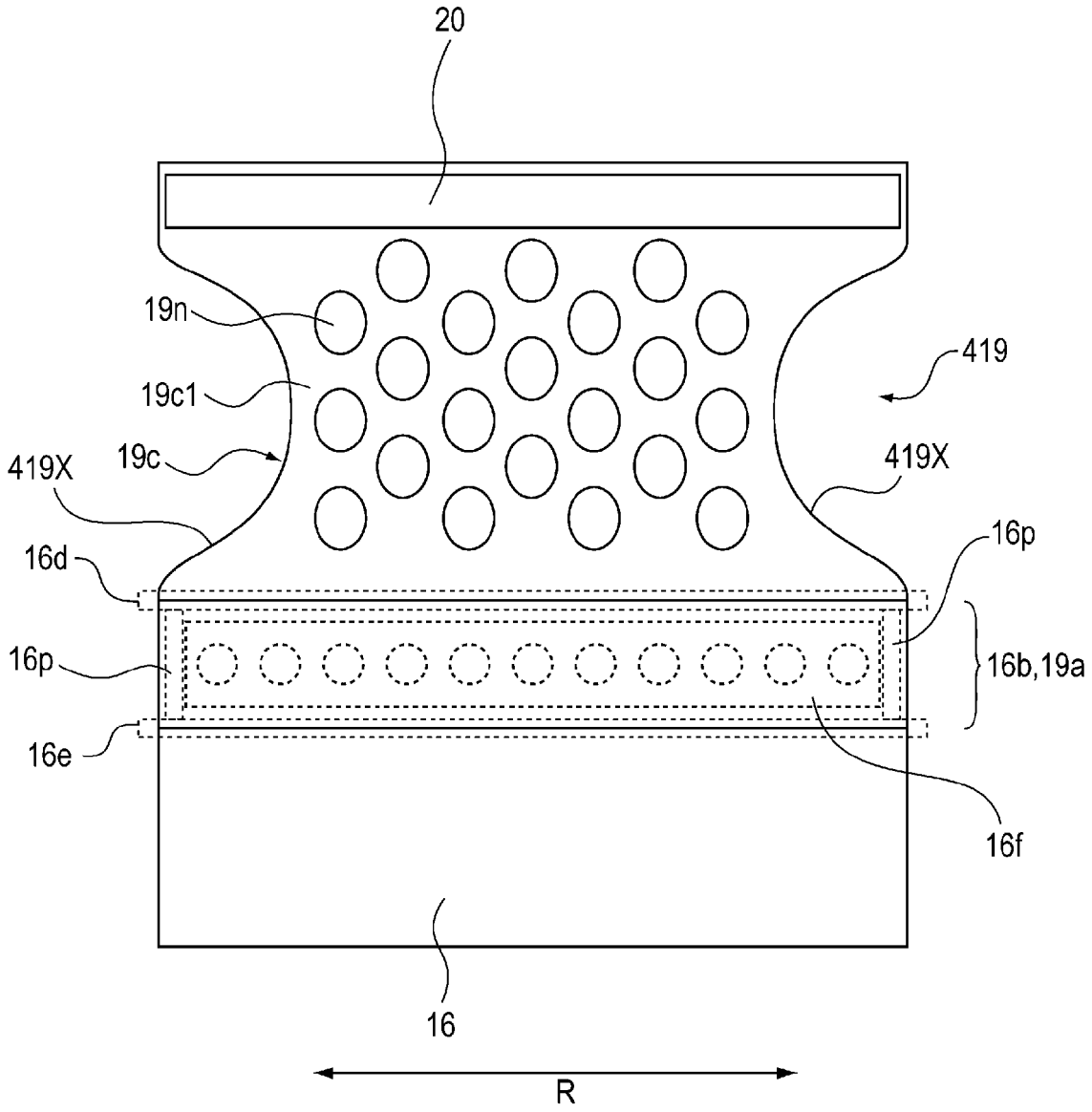
FIG. 14 is an enlarged plan view showing a structure of a sealing member before being disposed in a developer accommodating unit according to Embodiment 4.

FIG. 4 is an enlarged plan view showing a structure of a sealing member 419 before being provided in a developer accommodating unit in this embodiment. Other than the constitutions described above, it is possible to employ a constitution in which the developer passing portion is formed by changing a shape of the connecting portion 19*c* of the sealing member 419 so that the developer is discharged in a larger amount at the end portion with respect to the axial direction R of the unsealing member 20. For example, as shown in FIG. 14, the continuous member 19*c*1 may also be formed in a smaller size than the sealing portion 19*a* and the holding portion 19*b* with respect to the axial direction R of the unsealing member 20. To put it briefly, the connecting portion 19*c* has a cut-away portion in a curved shape at end portions with respect to the rotational axis direction thereof. This shape may also be applied to the constitutions in Embodiments 1 to 3.

According to the constitution in Embodiment 1, there is no effort of the user to remove the unsealing member, so that the developer discharging efficiency from the developer bag 16 in which the developer is accommodated. Particularly, while using the sealing member 19 for improving flowability of the developer, it is possible to suppress a phenomenon that flow of the developer which flows from the openings 16*c* is prevented by the sealing member 19 after the unsealing member 20 is operated to release the sealing of the openings 16*c* by the sealing member 19. Further, in this way, by employing the constitution in which the release of the sealing by the sealing member 19 can be effected by the inside member, there is no need for the user to pull out the sealing member 19 of the cartridge A, so that the cartridge A can be replaced simply. This is true for also the constitutions in Embodiments 2 and 3.

According to the constitution in Embodiment 3, the holes 19*n*2 of the continuous member 19*c*1 are formed in the larger size at the end portion than at the central portion. As a result, the developer can pass through the holes 19*n*1 in the central side and concurrently can pass through the holes 19*n*2 in the end side at a higher efficiency than that in the central side.

According to the constitution in Embodiment 4, the holes 19*n*2 of the continuous member 19*c*1 are formed in the small size than the surface and the holding portion 19*b* with respect to the axial direction R of the unsealing member 20. As a result, the developer can pass through the holes 19*n* and concurrently can pass through a portion outside a cut-away portion 419X of the continuous member 19*c*1 with respect to the axial direction R of the unsealing member 20.

According to the present invention, there is no effort of the user to remove the sealing member, and the developer discharging efficiency from the flexible container in which the developer is accommodated is improved.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 115868/2012 filed May 21, 2012, which is hereby incorporated by reference.

What is claimed is:

1. A developer accommodating unit comprising:

a flexible container, provided with an opening for permitting discharge of developer, for accommodating the developer;

a sealing member for sealing the opening by being mounted on said container and for being peeled from said container to expose the opening while deforming said container; and an unsealing member for peeling said sealing member from said container, wherein said sealing member includes (i) a sealing portion provided at an end side thereof to seal the opening, (ii) a holding portion provided at another end side thereof to be held by said unsealing member, and (iii) a developer passing portion connecting said sealing portion to said holding portion to permit passing of the developer therethrough.

2. A unit according to claim 1, wherein the developer passing portion is provided with a plurality of holes.

3. A unit according to claim 2, wherein of the plurality of holes, a hole in an end portion side is larger than a hole in a central portion side with respect to a direction perpendicular to an unsealing direction.

4. A unit according to claim 1, wherein said container is provided with a plurality of openings.

5. A unit according to claim 1, further comprising a frame for accommodating said container.

6. A unit according to claim 5, wherein said unsealing member is supported rotatably about a shaft relative to said frame, and wherein holes of said sealing member are set so as to pass through positions opposing the opening of said unsealing member when rotated.

7. A unit according to claim 1, further comprising an unsealing member for urging said container to deform said container.

8. A unit according to claim 1, wherein said sealing member is formed in a sheet shape.

9. A unit according to claim 1, wherein said developer passing portion includes a continuous member which is continuous between said sealing portion and said holding portion and includes a plurality of holes, provided in the continuous member, for permitting passing of the developer therethrough.

10. A unit according to claim 9, wherein said continuous member is shorter than said sealing portion and said holding portion with respect to an axial direction of said unsealing member.

11. A process cartridge detachably mountable to a main assembly of an electrophotographic image forming apparatus, comprising:

an image forming portion for forming an image; and a developer accommodating unit according to claim 1.

12. An electrophotographic image forming apparatus comprising:

an image forming portion for forming an image; and a developer accommodating unit according to claim 1.

13. A developing apparatus comprising:

a developer carrying member; and a developer accommodating unit according to claim 1.

14. A unit according to claim 1, wherein said developer passing portion includes a cut-away portion.

15. A developer accommodating unit comprising:

a container, provided with an opening for permitting discharge of developer, for accommodating the developer;

a sealing member for sealing the opening by being mounted on said container and for being peeled from said container to expose the opening; and an unsealing member for peeling said sealing member from said container, wherein said sealing member includes a sealing portion provided at end side thereof to seal the opening, a holding portion provided at another end side thereof to be held by said unsealing member, and a developer passing portion formed between said sealing portion and said holding portion to permit passing of the developer therethrough, wherein said developer passing portion is provided with a plurality of holes and a hole in an end portion side is larger than a hole in a central portion side with respect to a direction perpendicular to an unsealing direction.

16. A developing apparatus comprising:

a developer carrying member; and a developer accommodating unit according to claim 15.

17. A process cartridge detachably mountable to a main assembly of an electrophotographic image forming apparatus, comprising:

an image forming portion for forming an image; and a developer accommodating unit according to claim 15.

18. An electrophotographic image forming apparatus comprising:

an image forming portion for forming an image; and a developer accommodating unit according to claim 15.

19. A unit according to claim 15, wherein said a sealing member is peeled from said container while deforming the opening.

20. A unit according to claim 15, wherein said container is provided with a plurality of openings.

21. A unit according to claim 15, further comprising a frame for accommodating said container.

22. A unit according to claim 21, wherein said unsealing member is supported rotatably about a shaft relative to said frame, and wherein holes of said sealing member are set so as to pass through positions opposing the openings when said unsealing member is rotated.

23. A unit according to claim 15, further comprising an unsealing member for urging said container to deform said container.

24. A unit according to claim 15, wherein said sealing member is formed in a sheet shape.

25. A unit according to claim 15, wherein said developer passing portion includes a continuous member which is continuous between said sealing portion and said holding portion and includes a plurality of holes, provided in the continuous member, for permitting passing of the developer therethrough.

26. A unit according to claim 25, wherein said continuous member is shorter than said sealing portion and said holding portion with respect to an axial direction of said unsealing member.

* * * * *